United States Patent [19]

Youngblood

[11] Patent Number: 4,532,847

[45] Date of Patent: Aug. 6, 1985

[54] CONTROL ACCESSORY FOR AN ACOUSTICAL GUITAR

[76] Inventor: Paul E. Youngblood, 361-A S. Riverside Dr., Fort Worth, Tex. 76104

[21] Appl. No.: 529,837

[22] Filed: Sep. 6, 1983

[51] Int. Cl.[3] ..... G10H 3/00

[52] U.S. Cl. ..... 84/1.16; 84/1.27; 338/220

[58] Field of Search ..... 338/220, 69; 84/1.14, 84/1.16, 1.27

[56] References Cited

U.S. PATENT DOCUMENTS

| | | | |
|---|---|---|---|
| 1,970,149 | 8/1934 | Pugh, Jr. | 338/220 |
| 3,501,992 | 3/1970 | Osborn et al. | 84/1.16 |
| 3,662,223 | 5/1972 | Marshall | 84/1.16 |
| 4,338,846 | 7/1982 | Pogoda | 84/1.16 |

*Primary Examiner*—Forester W. Isen

*Attorney, Agent, or Firm*—Charles D. Gunter, Jr.

[57] ABSTRACT

A control accessory is shown for use with a standard acoustical guitar which has been fitted with an electrical pickup and a female input jack. The control accessory includes a male input jack having a jack case with a male portion extending therefrom which is engageable with the female jack portion on the guitar body. An electrical cord runs from the jack for electrically connecting the guitar pickup through the male and female jack portions to a power amplifier. A sound control is located on the male input jack for controlling the flow of electricity from the guitar pickup to the power amplifier to control the sound produced by the guitar.

4 Claims, 5 Drawing Figures

CONTROL ACCESSORY FOR AN ACOUSTICAL GUITAR

BACKGROUND OF THE INVENTION

The present invention relates generally to accessories for controlling the sound of an acoustical guitar and, specifically, to a volume and tone control accessory for such a guitar.

Acoustical guitars are known for a rich and mellow sound which some people favor over the sound produced by an electirc guitar. In order to increase the volume of acoustic guitars, however, these guitars are often fitted with an electrical pickup which is connected by means of an input jack to a standard electrical amplifier of the type used with an electric guitar. This arrangement allows the musician to obtain increased volume from his instrument while maintaining the desired acoustic character of the sound produced.

A common method for adapting a standard acoustical guitar for electrical play involves the insertion of a narrow metal strip called the "pickup" between the saddle and the bridge of the guitar proximate the point where the strings terminate at the saddle area. The pickup has two electrical leads which are passed within the guitar body to the female jack portion of a standard electrical input jack. The female jack portion can be passed through the "button hole" opening at the rear of the guitar body which normally retains the button strap for attaching one end of a guitar neck strap. By enlarging the button hole slightly, the female jack portion can protrude from the button hole without the necessity of cutting additional holes in the guitar body. This type of modification to the acoustical guitar is well known to those in the industry and allows the guitar to be electrically adapted with a minimum of alteration to the guitar body which is often times hand crafted and extremely valuable. Other pickups are mounted on the bridge plate on the inside of the body of the guitar, but otherwise the procedure is the same.

The female jack portion of the modified guitar would then be connected to a standard amplifier by using a connecting cord which was fitted with male jack portions at either end thereof. One male portion would be inserted within the female jack portion on the guitar and the male jack portion at the opposite end of the electrical cord would be inserted in a female jack portion on the power amplifier. The sound of the guitar could then be controlled by using the electrical controls on the power amplifier.

The disadvantage of this arrangement is that the power amplifier is often located in an inconvenient position for easy access by a performing musician.

There exists a need, therefore, for a control means for controlling the sound from an electrically adapted acoustical guitar which is easily accessible to the musician while performing.

There exists a need for such a control accessory which can be used with an electrically adapted acoustical guiter without the necessity of drilling or cutting additional openings in the guitar body or otherwise altering the appearance of the guitar.

SUMMARY OF THE INVENTION

The control accessory of the invention is intended to be used with a standard acoustical guitar which has been adapted to receive an electrical pickup mounted at the guitar saddle and which is electrically wired to a female jack portion which protrudes from the button hole on the body of the guitar. The control accessory includes a male input jack having a jack case with a male portion extending therefrom which is engageable with the female jack portion on the guitar body. An electrical cord runs from the case for electrically connecting the guitar pickup through the male and female jack portions to a power amplifier. Control means are provided as a part of the male input jack for controlling the flow of electricity from the guitar pickup to the power amplifier to control the volume of the guitar. The control means can be a volume control which includes a potentiometer located within the input jack case. The potentiometer has a control shaft which extends from the case and which is adapted to receive a control knob. The potentiometer is electrically wired between the electrical cord and the male input jack so that turning the control knob varies the electrical resistance of the control accessory to thereby control the volume of the guitar.

The control accessory of the invention can also include a tone control co-located with the volume control on the male input jack for controlling the tone of the guitar.

Additional objects, features and advantages will be apparent in the written description which follows.

DETAILED DESCRIPTION OF THE INVENTION

Figure 1:
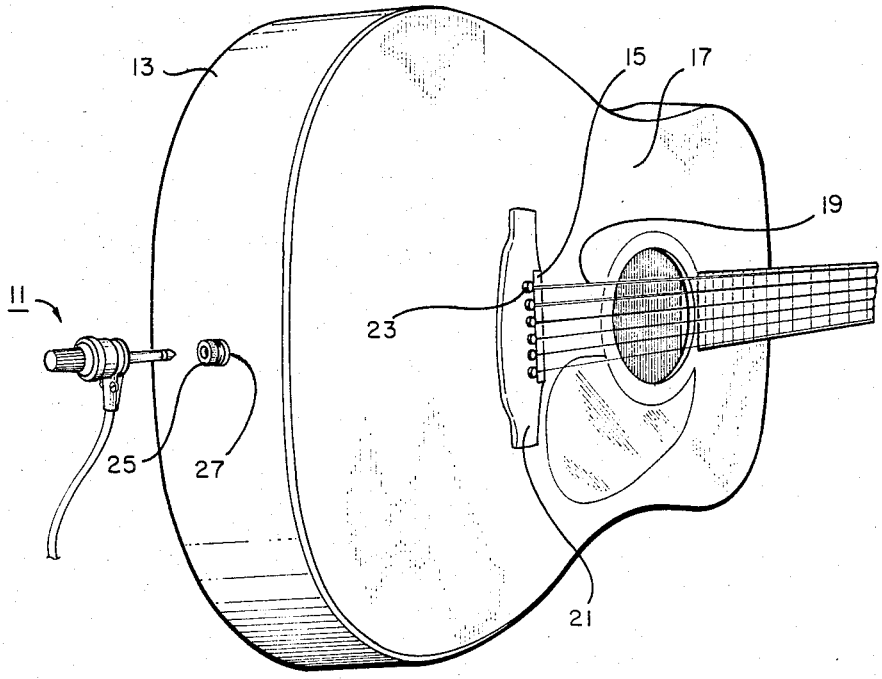
FIG. 1 is a perspective view of an electrically adapted acoustical guitar showing the installation of the control accessory of the invention.

FIG. 1 shows a control accessory of the invention designated generally as 11. The control accessory 11 is intended to be used with a standard acoustical guitar 13 which has been adapted to receive an electrical pickup 15. The pickup 15 is commercially available and includes a narrow strip of metal which is mounted between the saddle and bridge on the face 17 of the guitar 13 in the string region 19 at the saddle area 21 proximate the connecting points 23 where the strings 19 are connected to the saddle 21. The electrical pickup 15 includes two electrical leads (not shown) which run within the guitar body to the female jack portion 25 of a standard electrical input jack. The female jack portion 25, as shown in FIG. 1, protrudes from the button hole opening 27 at the rear of the guitar body.

Figure 2:
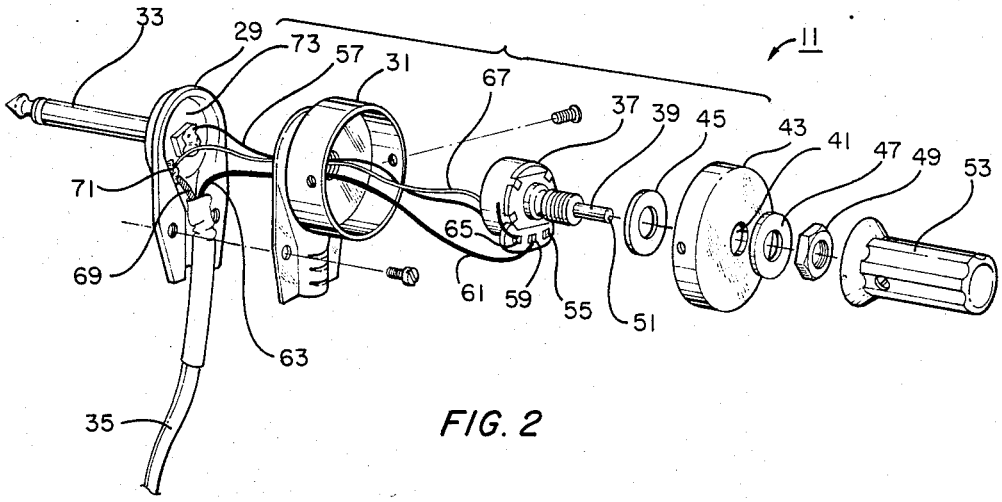
FIG. 2 is an exploded view of the control accessory of the invention with the cord shown broken away.

As shown in FIG. 2, the control accessory 11 includes a male input jack 29 having a jack case 31 and having a male portion 33 extending therefrom which is engageable with the female jack portion 25 on the guitar body. An electrical cord 35 runs from the jack 29 for electrically connecting the guitar pickup 15 through the male and female jack portions 33, 25 to a standard power amplifier.

As shown in FIG. 2, the control accessory 11 includes a volume control, such as potentiometer 37 located within the case 31 on the male input jack 29 for controlling the flow of electricity from the guitar pickup 15 to the power amplifier to control the volume of the guitar 13. The potentiometer 37 has a control shaft 39 which passes through an opening 41 in the case cover 43 and is retained in place by means of inner and outer washers 45, 47 and a retaining nut 49. The outer extent 51 of the control shaft 39 is adapted to receive a control knob 53 so that turning the control knob 53 varies the electrical resistance of the control accessory 11 to thereby control the volume of the guitar 15.

The potentiometer 37, as shown in FIG. 2, has a jack terminal 55 which is connected by a wire 57 to the electrically conductive portion of the male jack 33. The potentiometer 37 has a center terminal 59 which is connected by a wire 61 to the hot wire 63 passing out the electrical cord 35. The potentiometer 37 also has a ground terminal 65 which is grounded to the body of the potentiometer 37 and which is connected by a wire 67 to the ground wire 69 passing to the electrical cord 35. The ground wire 69 is also grounded at a solder point 71 to the base portion 73 of the male input jack 29.

Figure 5:
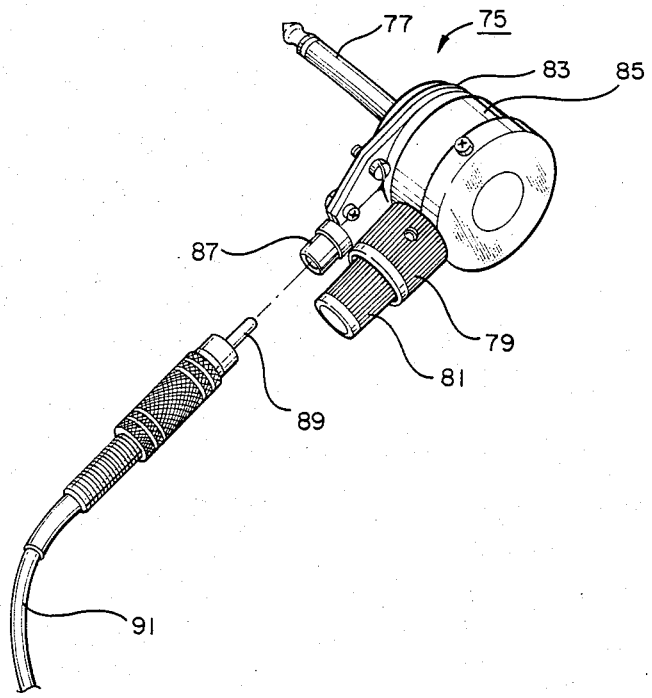
FIG. 5 is another embodiment of the control accessory of the invention similar to FIG. 3.

FIG. 5 shows another embodiment of the control accessory of the invention designated generally as 75. The control accessory 75 has a male jack portion 77, as previously described, for insertion within the female jack portion 25 on the guitar 13. The control accessory 75 shown in FIG. 5 also includes a tone control 79 co-located with the volume control 81 on the male input jack 83 for controlling the tone of the guitar between the desired bass and treble levels. The volume and tone controls 79, 81 extend from the jack case 85 at a generally right angle to the longitudinal axis of the male jack portion 77 in order to conserve space.

The embodiment of the control accessory shown in FIG. 5 also includes a female plug 87 on the male input jack 83 for receiving the mating male plug 89 of an electrical cord 91.

Figure 3:
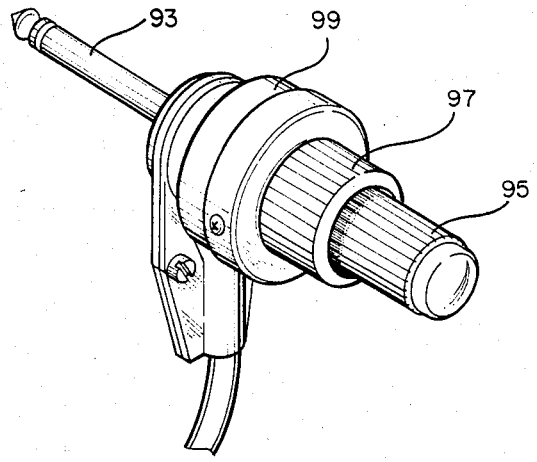
FIG. 3 is a close-up perspective view of one embodiment of the control accessory of the invention with volume and tone controls co-located on the control shaft.

Another embodiment of the control accessory of the invention is shown in FIG. 3. The control accessory shown in FIG. 3 includes a male jack portion 93 adapted to be received within the female jack portion 25 on the guitar body. The control accessory shown in FIG. 3 also includes volume and tone controls 95, 97 co-located on a control shaft extending from the jack case 99. In this case, however, the tone control 97 is concentrically located with the volume control 95 along the longitudinal axis of the male jack portion 93.

Figure 4:
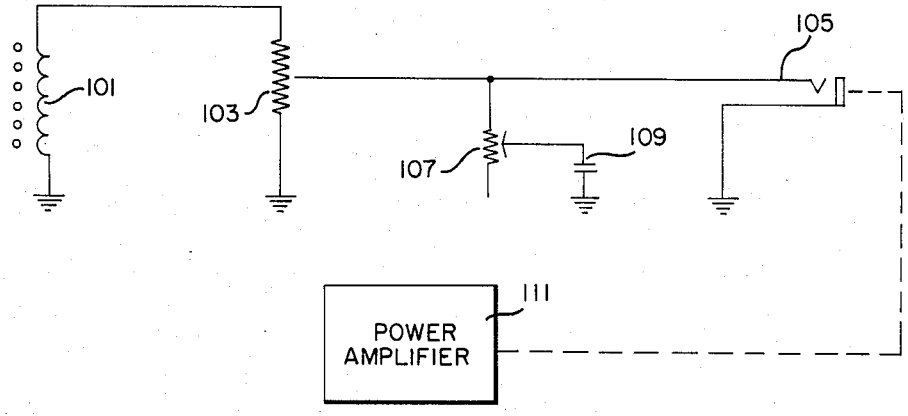
FIG. 4 is an electrical schematic of the electrical circuit of the control accessory of the invention.

FIG. 4 shows a simplified electrical schematic for a control accessory of the invention having volume and tone controls. The electrical circuit includes an electrical pickup 101 which is connected to a volume control pontentiometer 103, the center post of which is connected to an input jack 105. A tone control potentiometer 107 is connected between the jack 105 and pickup 101 and includes a capacitor 109. When the male jack portion 33 of the control accessory is inserted within the input jack 105, the pickup 101 is connected to the power amplifier 111, as shown in simplified form in FIG. 4.

An invention has been provided with several advantages. The control accessory of the invention provides a convenient means for manually controlling the sound of an electrically adapted acoustical guitar during a performance. The power amplifier can be located a long distance away from the performer while still providing complete control of volume and tone to the performer. The control accessory is compact in design and does not detract from the appearance of the guitar when in place. The control accessory works with a standard female jack which has been inserted within the button hole opening on the guitar body, thereby providing sound control without the need for cutting additional holes or openings within the guitar.

While the invention has been shown in only three of its forms, it is not thus limited but is susceptible to various changes and modifications without departing from the spirit thereof.

I claim:

1. A control accessory for a standard acoustical guitar which has been adapted to receive an electrical pickup, the pickup being mounted at the guitar saddle and being electrically wired to a female jack portion which protrudes from the button hole on the body of the guitar, the improvement comprising:

a male input jack having a jack case with a male portion extending therefrom which is engageable with said female jack portion on said guitar body;

an electrical cord running from said jack for electrically connecting said guitar pickup through said male and female jack portions to a power amplifier;

a volume control located on said male input jack for controlling the flow of electricity from said guitar pickup to said power amplifier to control the volume of said guitar, and wherein said volume control includes a pontentiometer located within said input jack case, said potentiometer having a control shaft which extends from said case and which is adapted to receive a control knob, said potentiometer being electrically wired between said electrical cord and said male input jack so that turning said control knob varies the electrical resistance of said control accessory to thereby control the volume of said guitar.

2. The control accessory of claim 1 further comprising:

a tone control co-located with said volume control on said male input jack for controlling the tone of said guitar.

3. The control accessory of claim 2, wherein said tone control has a tone control knob which is located on said potentiometer shaft concentric with said volume control.

4. A method of controlling the volume of a standard acoustical guitar which has been adapted to receive an electrical pickup, the pickup being mounted at the guitar saddle and being electrically wired to a female jack portion which protrudes from the button hole on the body of the guitar, comprising the steps of:

plugging a male input jack into said female jack portion, said male input jack having an electrical cord running therefrom for electrically connecting said guitar pickup through said male and female jack portions to a power amplifier;

providing said input jack with control means as a part of said male input jack for controlling the flow of electricity from said guitar pickup to said power amplifier, said control means including a potentiometer located within said male input jack, said potentiometer having a control shaft which extends from said male input jack and which is adapted to receive a control knob, said potentiometer being electrically wired between said electrical cord and said male input jack so that turning said control knob varies the electrical resistance of said control accessory to thereby control the volume of said guitar; and adjusting the volume of said guitar by turning said control knob and thereby hand-adjusting the control means on said male input jack while playing said guitar.

* * * * *